US005080296A

United States Patent [19]

Raggio et al.

[11] Patent Number: 5,080,296

[45] Date of Patent: Jan. 14, 1992

[54] LOW TENSION WIRE TRANSFER SYSTEM

[75] Inventors: William A. Raggio, Del Mar; Michael V. Fisher, San Diego, both of Calif.

[73] Assignee: General Atomics, San Diego, Calif.

[21] Appl. No.: 587,229

[22] Filed: Sep. 24, 1990

[51] Int. Cl.[5] ..... B65H 59/38

[52] U.S. Cl. ..... 242/45; 226/42; 226/44

[58] Field of Search ..... 242/45, 75.5, 75.51, 242/75.52; 225/42, 44, 45

[56] References Cited

U.S. PATENT DOCUMENTS

| | | | |
|---|---|---|---|
| 2,285,654 | 6/1942 | Hanna et al. | 242/45 |
| 2,981,491 | 4/1961 | Eans, Jr. | 242/45 |
| 4,530,471 | 7/1985 | Inoue | 242/45 |

*Primary Examiner*—Stanley N. Gilreath
*Attorney, Agent, or Firm*—Nydegger & Associates

[57] ABSTRACT

A system for maintaining a predetermined tension of a wire has a rotatable wire supply spool, a motor-driven wire take-up spool, a motor-drive wire feed spool. The wire is wound around the supply spool and is also attached to the take-up spool. The wire also passes partially around the feed spool and a pulley or guide which is attached to a pivot arm. The pivot arm is positioned between the take-up spool and the supply spool. A frictional layer is disposed around the outer circumferential surface of the feed spool, to prevent the wire from sliding across the frictional layer of the feed spool.

The elongated pivot arm that has its free end positioned against the wire. The pivot arm pivots in response to the differences in speed between the supply and take-up spool. A motion sensor detects motion of the pivot arm and generates a control signal in response. The control signal is electrically conducted to a stepper motor. The stepper motor is electrically connected in turn to the feed spool to establish the speed of rotation of the feed spool and thereby match the supply speed with the take-up spool speed. The pivot arm can be weighed and oriented at an angle different from its rest position angle to establish the desired tension on the wire.

7 Claims, 3 Drawing Sheets

| PARAMETER | STEP 1 | 2 | 3 | 4 | 5 |
|---|---|---|---|---|---|
| INPUT FROM A/D CONVERTER 98 (LIGHT PATH) | 0(BLOCKED) | 0(BLOCKED) | 1(UNBLOCKED) | 1(UNBLOCKED) | 0(BLOCKED) |
| INPUT FROM A/D CONVERTER 94 (DIRECTIONAL PIVOT ARM MOTION) | 1 (UP) | 0(DOWN) | 0(DOWN) | 1 (UP) | 1(UP) |
| OUTPUT (CLOSE RELAY TO ENERGIZE STEPPER MOTOR AND FEED MOTOR) | 1 (YES) | 1(YES) | 1(YES) | 0(NO) | 1(YES) |

LOW TENSION WIRE TRANSFER SYSTEM

FIELD OF THE INVENTION

The present invention relates generally to tension control systems. More particularly, the present invention relates to wire tension control systems. The present invention particularly, though not exclusively, relates to systems and apparatus that control the tension of a wire during a wire transfer process.

BACKGROUND OF THE INVENTION

A wide variety of manufacturing processes exist which require transferring a wire through a wire processing zone in order to coat or otherwise process the wire. For instance, several manufacturing processes exist for coating a wire substrate with a superconductor material. Examples of such processes are disclosed in co-pending U.S. patent applications Ser. No. 523,221 for an invention entitled "Melt Texturing of Long Superconductor Fibers"; and Ser. No. 528,707 for an invention entitled "Method for Electroplating of Yttrium Metal in Nonaqueous Solutions", both of which are assigned to the same assignee as the present invention.

Typically, processes such as the ones mentioned above require that the wire substrate be precisely drawn through a processing zone without radially supporting the wire. The wire ordinarily is not radially supported because radial support structure would otherwise interfere with the wire processing apparatus. Consequently, to ensure that the wire follows a substantially straight, precise path through the processing zone, it is necessary that the wire be kept in tension as the wire is drawn through the zone.

It is often the case that superconductor fabrication and other wire processing procedures require the use of a relatively thin and sometimes fragile metal wire or ceramic substrate. This can be unfortunate because, as is well-known, thin, fragile wire substrates, as well as ceramic superconductor substrates, typically have a low tensile strength. Thus, the tension of the substrate must be kept low enough to preclude breakage or deformation of the substrate during processing. On the other hand, as discussed above, the substrate must be kept in sufficient tension to keep the wire substrate radially aligned as the wire substrate passes through the processing zone. The present invention recognizes that the tension of a wire substrate which is passed through a processing zone can be established to ensure radial alignment of the wire in the zone, while avoiding wire breakage or deformation.

Accordingly, it is an object of the present invention to provide a system which establishes a predetermined tension of a wire during a wire processing procedure. Yet another object of the present invention is to provide a system which establishes the tension of a wire to preclude wire breakage or deformation while the wire passes through a processing zone. Finally, it is an object of the present invention to provide a wire tension control system which is relatively easy to use and comparatively cost-effective to manufacture.

SUMMARY OF THE INVENTION

A system for establishing a predetermined tension on a wire includes an apparatus on which are rotatably mounted a wire supply spool, a motor-driven wire take-up spool, and a motor-driven wire tension control spool. The respective motors of the wire take-up spool and the wire tension control spool have selectable speeds of rotation.

One end of a wire can be wound around the rotatable wire supply spool and the other end of the wire can be attached to the rotatable wire take-up spool. Consequently, the wire take-up spool can be rotated to take up wire from the wire supply spool. Importantly, as the wire extends between the wire supply spool and the wire take-up spool, the wire also passes partially around the outer circumferential surface of the wire feed spool. A frictional layer, e.g., rubber or latex, is attached to the outer circumferential surface of the wire feed spool. This frictional layer allows the feed spool to effectively grab the wire and pull it off the supply spool. Thus, the wire can be fed from the wire supply spool to the wire take-up spool only when the wire feed spool is rotated in the appropriate direction. Consequently, as the wire take-up spool rotates to take up wire from the wire supply spool, the feed spool pulls the wire form the supply spool at the same speed as the wire is taken onto the take up spool.

To establish the speed of rotation of the feed spool, the tension control system senses the speed of the take up spool and establishes the speed of rotation of the wire feed spool in response thereto. More specifically, the tension control system includes an elongated pivot arm (e.g., a teeter totter) which has a free end and a pivot end. The pivot arm is rotatably attached to the apparatus at a pivot point. A curved guide or pulley is attached to the free end of the pivot arm, and the wire is positioned against the guide or around the pulley. Consequently, as the speed of the take up spool changes with respect to the supply spool, the wire urges against the guide (and, hence, the pivot arm) and thereby moves the guide and pivot arm. Any tension in the system is provided by the pivot arm itself, by attaching a weight or spring to the arm.

A light source is positioned at a distance from a light receiver to establish a gap therebetween into which the pivot arm can swing. Consequently, the light receiver can generate a signal which indicates whether the pivot arm is in the gap and blocking the light path from the light source to the light receiver. Furthermore, the signal from the light receiver provides an indication of the position of the pivot arm. Also, a potentiometer is connected to the pivot end of the pivot arm to sense the direction of rotation of the pivot end (i.e., the direction of pivotal motion of the pivot arm). Thus, the potentiometer generates a signal indicative of the direction of rotational motion of the pivot end of the pivot arm.

The signals from the potentiometer and the light receiver are electrically conducted to a microprocessor which processes the signals to develop a control signal. In accordance with the present invention, the control signal is electrically connected to a stepper motor to selectively energize the stepper motor. In turn, the stepper motor is mechanically coupled to a potentiometer which is included in the power supply circuitry of the motor of the wire tension control spool. Consequently, as the stepper motor is selectively energized, the resistive setting of the potentiometer is adjusted by the stepper motor to thereby control the speed of the wire feed spool motor and thus match the speed of the feed spool with the speed of the take up spool.

In an alternate embodiment, the wire supply spool is motorized, and a wire feed spool is not used. In this embodiment, the tension of the wire is established by appropriately preselecting a steady state orientation for the pendulum. Additionally, however, the speed of the wire supply spool is matched directly with the speed of the take up spool. Also, a second light source and second light receiver can be positioned on the apparatus to sense when the pivot arm is in a substantially free-hanging position or has dropped too low, i.e. to sense when there is substantially no tension on the wire. When the wire is slack or broken, the second light receiver sends a signal to a relay which is included in the power supply circuitry of the motor of the wire supply spool and the stepper motor, to cause the relay to interrupt power to the motor of the wire supply spool and thereby prevent overfeeding of the wire.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF THE PREFERRED EMBODIMENT

Figure 1:
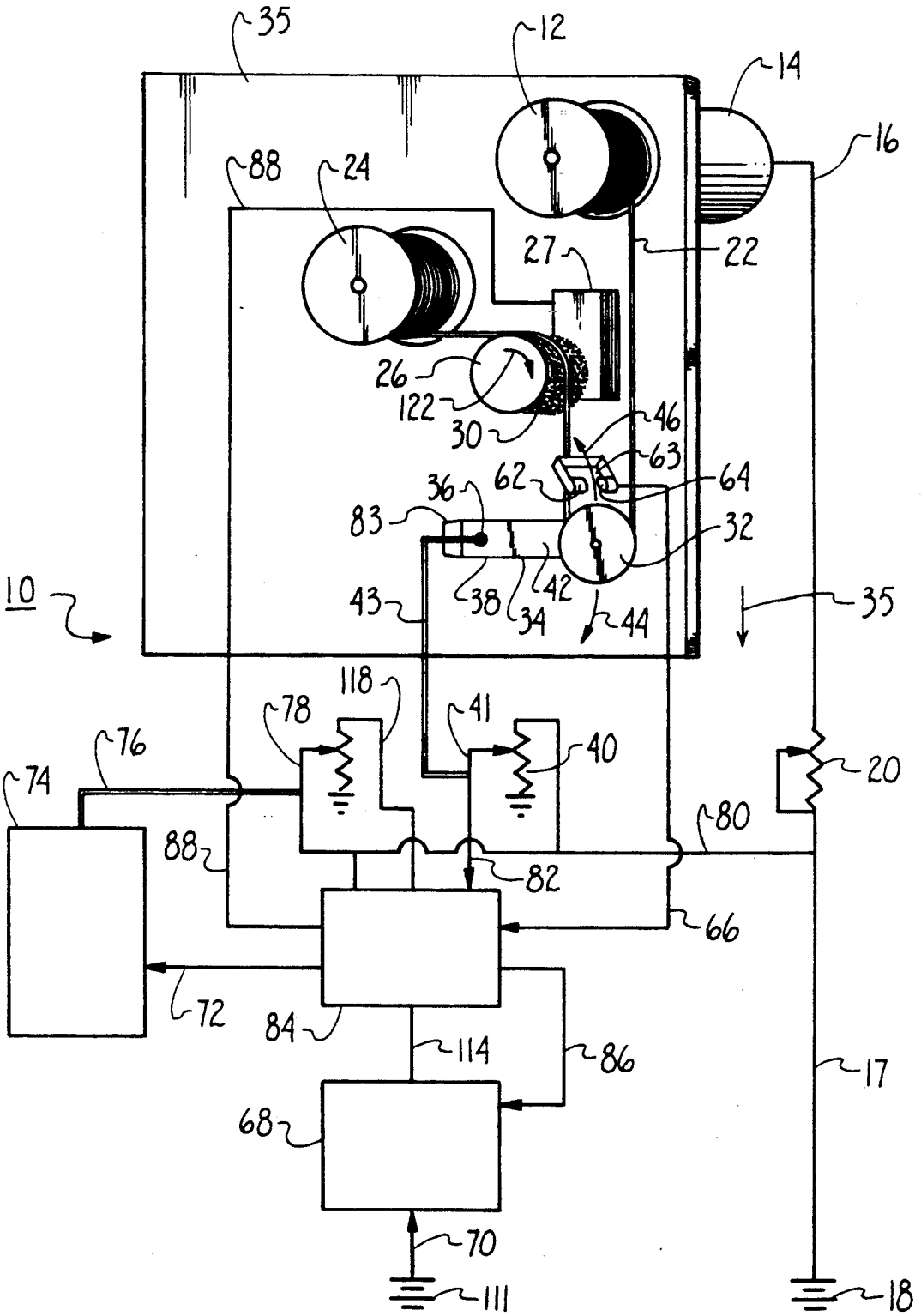
FIG. 1 is a schematic view of the novel wire transfer system of the present invention.

Referring initially to FIG. 1, an apparatus for controlling the tension of a wire in accordance with the present invention is shown and generally designated 10. Apparatus 10 includes a wire take-up spool 12 which is rotatably mounted on apparatus 10. Take-up spool 12 is rotated by a suitable alternating current (ac) or direct current (dc) motor 14. In the embodiment shown, motor 14 is a dc motor and is energized through electrical lines 16 and 17 by a power source 18. A manually adjustable variable resistance potentiometer 20 is connected to line 16 to establish the voltage present on line 16 and thereby establish the speed of rotation of motor 14 (and, hence, the speed of rotation of take-up spool 12). FIG. 1 also shows that a wire 22 can be attached to take-up spool 12 by any suitable means, for example by winding a portion of wire 22 around take-up spool 12. Wire 22 can be any wire which is appropriate for the particular application of apparatus 10. For example, in applications of apparatus 10 wherein wire 22 is to be coated with a superconductor material, wire 22 is an appropriate nickel alloy wire that is approximately fifty (50) to one hundred fifty (150) microns in diameter. Alternatively, wire 22 could be a ceramic superconductor wire which is to be wound around take-up spool 12 incident to a superconductor manufacturing process.

Still referring to FIG. 1, wire 22 is shown wound around a wire supply spool 24. Supply spool 24 is freely rotatably mounted on apparatus 10, and preferably freely rotates with a minimum of rotational friction. FIG. 1 also shows that wire 22 passes partially around a wire feed spool 26, which is rotatably mounted on apparatus 10 between supply spool 24 and take-up spool 12. Spool 26 rotates in the direction of arrow 122. Wire feed spool 26 is rotated by a motor 27.

Importantly, a layer 30 of frictional material, e.g., rubber or latex, is deposited on or otherwise attached to the outer circumferential surface of wire feed spool 26 to prevent wire 22 from sliding freely over layer 30.

FIG. 1 further shows that a pulley 32 is fixedly attached to an elongated pivot arm 34, and that pivot arm 34 is pivotably attached to a base 35 on apparatus 10 between wire take-up spool 12 and wire tension control spool 26. As shown in FIG. 1, guide 32 is configured as a freely rotating pulley, and wire 22 is positioned against the periphery of pulley 32. Pivot arm 34 is attached to apparatus 10 by a pivot pin 36, which extends from pivot end 38 of pivot arm 34. Pivot pin 36 is rotatably attached to apparatus 10. FIG. 1 shows that the longitudinal axis of pivot arm 34 is substantially normal to the direction of the force of gravity, indicated by arrow 35. Also, the adjustable center tap 41 of a potentiometer 40, shown schematically in FIG. 1, is mechanically attached through linkage 43 to pivot pin 36 and is consequently rotated when pivot pin 36 rotates. Thus, the output signal of potentiometer 40 on line 82 is adjusted as pivot arm 34 pivots. To increase or decrease the tension on wire 22 a fixed force, e.g. a wight 83, can be positioned on pivot arm 34 on either side of the pivot point.

Importantly, FIG. 1 shows that free end 42 of pivot arm 34 is attached to guide 32, which in turn is in contact with wire 22. Consequently, as the difference in speed between the feed spool 26 and take up spool 12 goes positive and negative, the force of wire 22 against pulley 32 causes free end 42 of pivot arm 34 to move in the directions indicated by arrows 46 (i.e., counterclockwise) and 44 (i.e., clockwise).

Still referring to FIG. 1, a light source 62 is shown positioned on apparatus 10 on one side of pivot arm 34 and a light receiver 64 is shown distanced from source 62 to establish a gap 63 therebetween. Light source 62 sends a signal to microprocessor 84 to indicate whether wire 22 has pulled the pivot arm 34 within gap 63. More particularly, light source 62 and light receiver 64 are any well-known optical sensing devices which are positioned on apparatus 10 such that the light path between source 62 and receiver 64 will be blocked by pivot arm 34 when the take-up spool 12 is rotating faster than the feed spool 26. Stated differently, pivot arm 34 blocks the light path between source 62 and receiver 64 when pulley 32 is above a predetermined center point (as disclosed below) in the direction of arrow 46.

FIG. 1 also shows that a stepper motor controller 68 is included in apparatus 10. Stepper motor controller 68 is any suitable stepper motor controller well-known in the art. Dc power from a power source 111 is conducted to stepper motor controller 68 through electrical line 70. Stepper motor controller 68 in turn relays this dc power through a microprocessor 84 and lines 114 and 72 to a stepper motor 74, to cause the rotor (not shown) of stepper motor 74 to rotate. The rotor of stepper motor 74 is in turn mechanically coupled to a shaft 76. Consequently, as the rotor of stepper motor 74 rotates, shaft 76 also rotates. The direction in which stepper motor 74 causes shaft 76 to rotate is established by stepper motor controller 68. Shaft 76 is in turn mechanically coupled to the adjustable center tap of a potentiometer 78. Potentiometer 78 is electrically connected to power source 18 via lines 17 and 80. Accordingly, as shaft 76 is rotated, the resistive setting of potentiometer 78 is adjusted. The output of potentiometer 78 is sent via line 118 to dc motor 27 of wire feed spool 26. In accordance with well-known principles, the speed of dc motor 27 (and, hence speed of rotation of wire feed spool 26) is established by the adjustable resistive setting of potentiometer 78.

Finally, FIG. 1 shows that the electrical signal generated by potentiometer 40 in response to pivotal motion of pivot arm 34 is sent via line 82 to a microprocessor 84. Also, the signal from light receiver 64 is sent to microprocessor 84 via line 66. Microprocessor 84 includes various electronic components which will be more fully disclosed below. Microprocessor 84 is in turn electrically connected to stepper motor controller 68 via line 86, and to dc motor 27 via line 88, for operation to be shortly disclosed.

Figure 2:
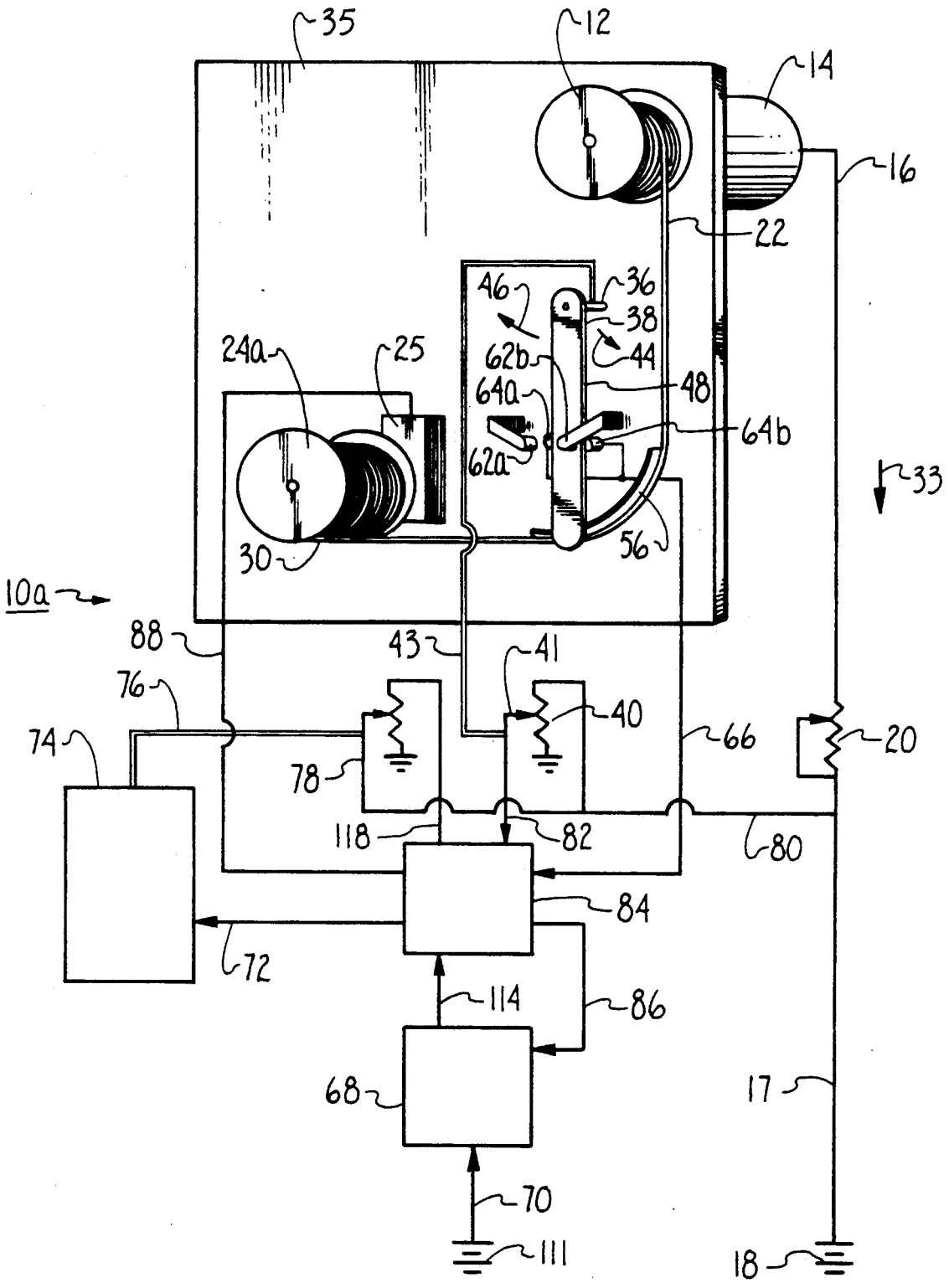
FIG. 2 is a schematic view of an alternate embodiment of the novel wire transfer system of the present invention.

Referring for the moment to FIG. 2, an alternate embodiment of the present invention is shown and designated 10*a*. More particularly, as shown in FIG. 2, apparatus 10*a* does not have a wire feed spool. Instead, apparatus 10*a* has a wire supply spool 24*a* which is rotated by a motor 25. Motor 25 is electrically connected to microprocessor 84 via electrical line 88. Also, apparatus 10*a* has an elongated pivot arm 48 which is pivotably mounted on apparatus 10*a*. Pivot arm 48 is a pendulum. More particularly, pivot arm 48 includes a pivot pin 36 which is rotatably attached to apparatus 10*a*. The center tap 41 of a potentiometer 40 is mechanically engaged with pivot pin 36 through an appropriate linkage 43. Potentiometer 40 is in turn electrically connected to microprocessor 84. Free end 42 of pivot arm 48 is fixedly attached to a curved guide 56. As shown in FIG. 2, curved guide 56 is arcuate in shape and defines an open curve, although it is to be understood that guide 56 could alternatively be shaped as a closed curve, e.g. as a disc or pulley. Any tension on the wire 22 is created by the force of the arm 48 hanging at a preselected orientation, i.e. at a predetermined angle away from the vertical position.

Wire 22 is shown slidably positioned against guide 56. It is to be understood that pivot arm 48 hangs freely when there is substantially no tension on wire 22, i.e., pivot arm 48 is substantially parallel to the direction of the force of gravity, indicated by arrow 33 in FIG. 2. Accordingly, as the differences in speed between spool 12 and spool 26 changes, pivot arm 48 moves in the directions indicated by arrows 46, 44, respectively.

Additionally, FIG. 2 shows that a first light source 62*a* is fixedly mounted to apparatus 10*a* and distanced from a first light receiver 64*a* to establish a gap therebetween. As can be easily appreciated, when first arm 48 enters this gap, the light circuit between light source 62*a* and light receiver 64*a* will be broken to indicate that pivot arm 48 has exceeded a predetermined tension angle in the direction of arrow 46. Stated differently, the light path between source 62*a* and receiver 64*a* is blocked by pivot arm 48 when the speed of the take up spool 12 exceeds that of supply spool 24. As shown in FIG. 2, receiver 64*a* is electrically connected to microprocessor 84.

Finally, FIG. 2 shows that a second light source 62*b* and a second light receiver 64*b* are fixedly positioned on apparatus 10*a* to indicate when wire 22 is substantially slack, or broken. More particularly, pivot arm 48 interrupts the light path between light source 62*b* and receiver 64*b* when there is substantially no tension on wire 22. Receiver 64*b* is electrically connected to microprocessor 84 to send a signal to microprocessor 84 which indicates when wire 22 is substantially slack. In response to this signal, microprocessor 84 interrupts power to motor 25 and stepper motor 74. As the skilled artisan will appreciate, the signal from light receiver 64*b* accordingly causes electrical power to motor 25 to be interrupted to prevent continued feeding of wire 22 when take-up spool 12 has stopped or otherwise failed to take-up wire 22 at a rate which is sufficient to keep up with supply spool 24.

It is to be understood that the remainder of the components of apparatus 10*a* are in all essential respects identical to the correspondingly numbered components of apparatus 10 disclosed above. Now referring to FIG. 3, the details of microprocessor 84 can best be seen. There, microprocessor 84 is shown to include an electronic differentiator 90. Differentiator 90 is electrically connected to potentiometer 40 via line 82 for the purpose of electronically differentiating the signal from potentiometer 40. More specifically, as the difference in speed between the take-up spool 12 and feed spool 26 changes, i.e., becomes relatively more positive or negative, pivot arm 34 is respectively pivoted in the direction indicated by arrow 46 or 44, in accordance with previous disclosure. This motion of pivot arm 34 accordingly causes pivot pin 36 to rotate in the direction indicated by arrows 46 or 44. As pivot pin 36 rotates in the direction of arrow 46 or 44, the resistive setting of the center tap 41 of potentiometer 40 is adjusted to respectively increase or decrease the voltage output of potentiometer 40. An increasing output of potentiometer 40 is converted to a positive voltage signal by differentiator 90. On the other hand, a decreasing output of potentiometer 40 is converted to a negative voltage signal by differentiator 90.

For apparatus 10*a*, as the differences in the angular speeds of rotation between spool 12 and spool 24 changes (more positive or negative), pivot arm 48 is respectively pivoted in the direction indicated by arrow 46 or 44. This motion of pivot arm 48 accordingly causes pivot pin 36 to rotate in the direction indicated by arrow 46 or 44, to adjust the center tap 41 of potentiometer 40. The operation of potentiometer 40 in apparatus 10*a* is in all other essential respects identical to the operation of potentiometer 40 in FIG. 1, disclosed above.

Again referring to FIG. 3, the output signal of differentiator 90 is amplified by a suitable amplifying device, such as operational amplifier 92. The amplified signal from operational amplifier 92 is then electrically conducted to analog-to-digital (A/D) converter 94. A/D converter 94 is any well-known device which can digitize the analog signal from operational amplifier 92. For example, A/D converter 94 can be an electronic comparator. In accordance with well-known principles, A/D converter 94 outputs a digital "1" signal if the analog signal from operational amplifier 92 is positive, and a digital "0" signal if the analog signal from amplifier 92 is negative. The output signal from A/D converter 94 is then sent to a NAND gate 96. In accordance with standard NAND gate operation, NAND gate 96 outputs a digital "0" signal in response to two input digital "1" signals. Otherwise, the output signal of NAND gate 96 is a digital "1".

Figures 3, 4:
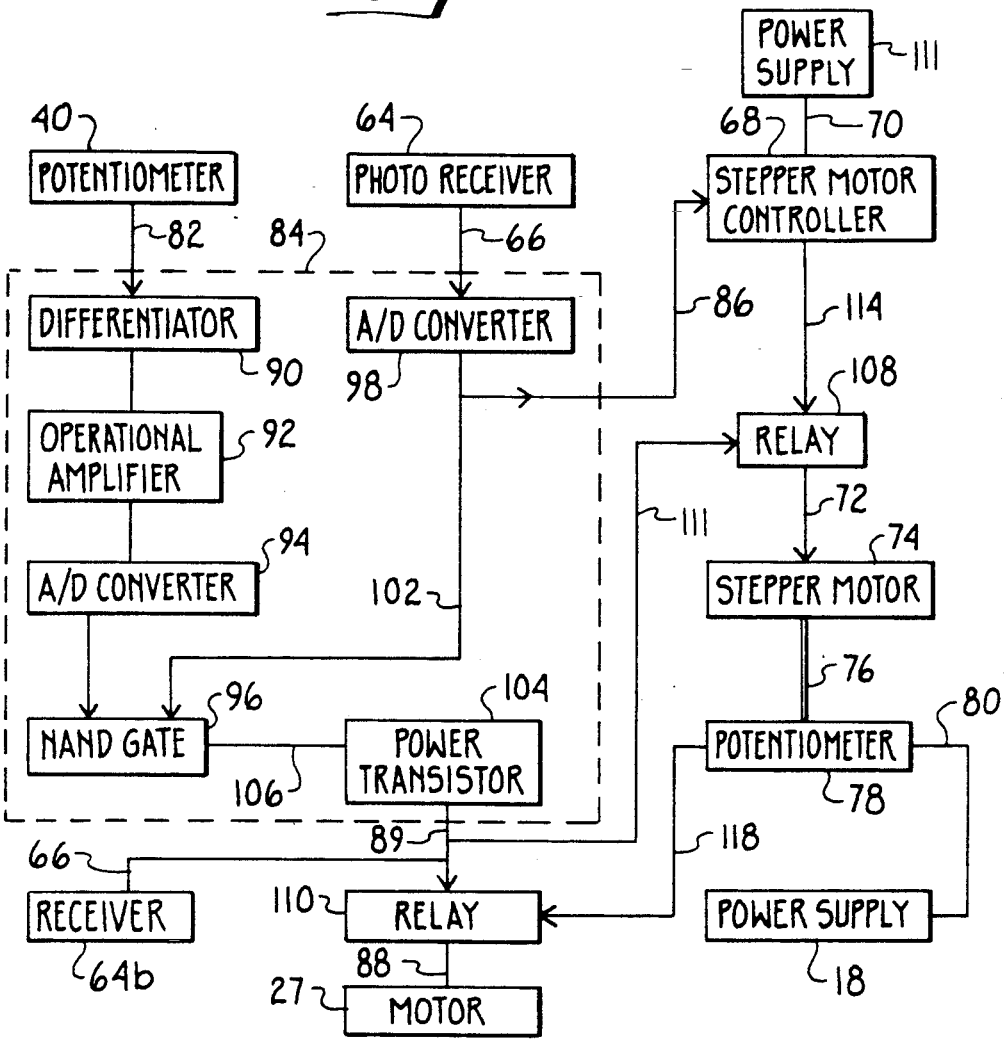
FIG. 3 is a schematic view of the electrical components of the novel wire transfer system.
FIG. 4 is a table showing the logic of the microprocessor of the novel wire transfer system.

FIG. 3 also shows that microprocessor 84 includes an A/D converter 98. A/D converter 98 is electrically connected to light receiver 64 via line 66 and converts the analog signal from light receiver 64 into a digital signal. The analog signal from light receiver 64 (and, hence, the digital output signal from A/D converter 98) indicates whether pivot arm 34 is blocking the light path from light source 62 to light receiver 64. More particularly, when pivot arm 34 blocks the light path between source 62 and light receiver 64, light receiver 64 outputs a "blocked" signal to A/D converter 98. In turn, A/D converter 98 outputs a digital "0" signal to NAND gate 96 and controller 68. On the other hand, when pivot arm 34 does not block the light path between light source 62 and light receiver 64, light receiver 64 outputs a "not blocked" signal to A/D converter 98. In turn, A/D converter 98 outputs a digital "1" signal to NAND gate 96 and controller 68. As shown in FIG. 3, the digital signal from A/D converter 98 is electrically conducted to NAND gate 96 and stepper motor controller 68 via respective electrical lines 102, 86. It is to be understood that light receiver **64*a* in the embodiment shown in FIG. 2 sends a "blocked" signal to A/D converter 98 when pivot arm 48 blocks the light path between source 62*a* and receiver 64*a*. Otherwise, receiver 64*a* sends a "not blocked" signal to converter 98**.

Continuing with the description of the electrical circuitry shown in FIG. 3, a power transistor 104 is shown electrically connected to NAND gate 96 via line 106, for the purpose of amplifying the output signal of NAND gate 96. The amplified output signal of power transistor 104 is in turn sent to relays 108, 110 via respective electrical lines 111, 89. Relay 108 is electrically connected to stepper motor controller 68 via electrical line 114. On the other hand, relay 110 is connected between potentiometer 78 and motor 27 via respective electrical lines 118, 88. Relays 108, 110 are preferably mounted in the housings of microprocessor 84.

Depending on the digital output signal from NAND gate 96 as more fully disclosed below, relays 108, 110 are either both energized to function as respective electrical short circuits or both deenergized to function as respective electrical open circuits. Stated differently, NAND gate 96 controls relay 108 (housed within microprocessor 84) to selectively pass dc voltage from power source 111 to stepper motor 74 through line 70, stepper motor controller 68, line 114, and line 72. Also, for the embodiment shown in FIG. 1, NAND gate 96 controls relay 110 to selectively pass dc voltage from power source 18 to wire tension control spool motor 27 through line 80, potentiometer 78, line 118, and line 88. On the other hand, for the embodiment shown in FIG. 2, NAND gate 96 controls relay 110 to selectively pass dc voltage from battery 18 to supply spool motor 25 through line 80, potentiometer 78, line 118, and line 88. For the embodiment shown in FIG. 2, photo receiver **64*b* is also electrically connected to the output of the power transistor 104 to disable the transistor 104 and thus open relays 108 and 110 when arm 48 interrupts the light path between source 62*b* and receiver 64*b***.

OPERATION

In the overall operation of apparatus 10, dc motor 14, shown in FIG. 1, is energized from power source 18 to cause wire take-up spool 12 to rotate. The wire 22 goes from the take-up spool 22, around the pulley 32 on the pivot arm 34, partially around the feed spool 26, and then to the supply spool 24. The speed of rotation of motor 14 (and, hence, speed of rotation of take-up spool 12) is established by appropriately adjusting potentiometer 20. In contrast, feed spool 26 is initially not rotating. Recall that the outer surface of feed spool 26 has a frictional layer 30 disposed thereon so that wire 22 does not slide freely over feed spool 26. Consequently, as the take-up spool 12 is rotated, the pivot arm 34 begins to rise.

As the difference in angular rotational speeds between spool 12 and spool 26 increases in accordance with the above disclosure, the difference of speeds causes free end 42 of pivot arm 34 to move in the direction indicated by arrow 46. As pivot arm 34 accordingly pivots, pivot arm 34 blocks the light path from light source 62 to light receiver 64. Light receiver 64 accordingly sends a "blocked" signal to A/D converter 98, shown in FIG. 3. A/D converter 98 digitizes the "blocked" signal from light receiver 64 and sends a digital "0" signal to NAND gate 96. Also, as pivot arm 34 pivots in the direction indicated by arrow 46, the voltage output of potentiometer 40 is accordingly increased. This increased output signal of potentiometer 40 is processed as previously disclosed through differentiator 90, operational amplifier 92, and A/D converter 94 and then input as a digital "1" to NAND gate 96.

It is to be understood that the process described above is represented at step 1 of FIG. 4, which is a table that represents the logic of NAND gate 96. As seen in FIG. 4, at step 1, NAND gate 96 receives a "0" input form A/D converter 98 and a "1" input form A/D converter 94. In accordance with well-known principles, NAND gate 96 outputs a digital "1" signal to relays 108, 110 to close relays 108, 110. Consequently, the electrical circuit from power source 18 to feed spool motor 27 is completed through relay 110, while the electrical circuit from power source 111 to stepper motor 74 is completed through relay 108. Thus, both motor 27 and stepper motor 74 are energized when NAND gate 96 outputs a digital "1" signal. Importantly, the digital "0" output signal of A/D converter 98 is also sent to stepper motor controller 68 via line 86, shown in FIG. 3. The digital signal from A/D converter 98 causes stepper motor controller 68 to establish the direction of rotation of the rotor (not shown) of stepper motor 74 (and, hence, the direction of adjustment of potentiometer 78). When the signal from A/D converter 98 is a digital "0", stepper motor controller 68 causes stepper motor 74 to continuously adjust the resistive setting of the center tap of potentiometer 78 such that the voltage drop across potentiometer 78 continuously decreases. Consequently, the voltage present on lines 118, 88 continually increases to cause feed spool motor 27 to rotate in the direction of arrow 122 (shown in FIG. 1) at a relatively faster rate.

As the speed of rotation of feed spool 26 accordingly increases with respect to the take up spool 12 speed, the difference in speeds correspondingly decreases. The upward motion (in the direction of arrow 46) of the pivot arm 34 decreases to zero motion, when both spools 12, 26 are at the same speed, and then, as the feed spool 26 speed continues to increase, the pivot arm 34 begins to move downward, i.e., in the direction of arrow 44 in FIG. 1. This step in the operation of apparatus 10 is represented at step 2 in FIG. 4. As seen in FIG. 4, the digital signal from A/D converter 94 changes to a "0" in response to the above-described change of pivot arm 34 direction of motion. Nevertheless, the output of NAND gate 96 remains a digital "1". Consequently, feed spool motor 27 remains energized through relay 110, and stepper motor 74 continues to adjust potentiometer 78 to increase the speed of rotation of motor 27 (and, hence, increase the speed of rotation of tension control spool 26).

As the feed spool 26 continues to speed up with respect to the take-up spool 12, pivot arm 34 continues to move downward, i.e., in the direction of arrow 44, until arm 34 no longer blocks the light path between light source 62 and light receiver 64. Consequently, light receiver 64 sends a "not blocked" signal to A/D converter 98, which causes the digital output signal from A/D converter 98 to change from a "0" to a "1". This step in the operation of apparatus 10 is represented at step 3 in FIG. 4. The digital signal from A/D converter 94, however remains "0", so that the output of NAND gate 96 remains a digital "1", and relays 108, 110 remain closed. In response to the "1" signal from A/D converter 98, however, stepper motor controller 68 changes state to cause stepper motor 74 to reverse the direction of adjustment of the center tap of potentiometer 78. Accordingly, the voltage drop across potentiometer 78 increases to cause the voltage present on lines 118, 88 to decrease. Consequently, the speed of rotation of feed spool motor 27 in the direction of arrow 122 slows.

Accordingly, as the speed of rotation of feed spool 26 slows, the difference in speed between the feed spool 26 and take-up spool 12 again decreases until pivot arm 34 again begins to move upward, i.e., in the direction of arrow 46. At this step in the operation of apparatus 10, indicated at step 4 in FIG. 4, the speed of rotation of tension control spool 26 is approximately equal to the speed of rotation of take-up spool 12. At step 4 of FIG. 4, the light path between source 62 and receiver 64 remains unblocked and, accordingly, the signal from A/D converter 98 to NAND gate 96 remains a digital "1". The signal from A/D converter 94, however, changes to a digital "1" to indicate that pivot arm 34 is again moving upward, i.e., in the direction of arrow 46. Consequently, the digital signal output of NAND gate 96 changes from a "1" to a "0", which causes relays 108, 110 to open. Accordingly, relays 108, 110 respectively interrupt power to stepper motor 74 and feed spool motor 27. Thus, feed spool motor 27 stops, and stepper motor 74 ceases to adjust the center tap of potentiometer 78. Consequently, the resistive setting of potentiometer 78, which corresponds to a speed of rotation of feed spool 26 that is approximately equal to the speed of rotation of take-up spool 12, ceases to be adjusted by stepper motor 74 at step 4.

Upon the stopping of feed spool motor 27 at step 4, the pivot arm 34 continues to move upward in the direction of arrow 46, until pivot arm 34 blocks the light path between light source 62 and light receiver 64. This step is represented at step 5 in FIG. 4. At step 5, the digital output signal of A/D converter 98 changes from a "1" to a "0", which causes the digital output signal of NAND gate 96 to change from a "0" to a "1". Accordingly, relays 108, 110 are activated to close, and stepper motor 74 and feed spool motor 27 are respectively energized. Importantly, as disclosed above, the setting of potentiometer 78 in steps 4 and 5 corresponds to a feed spool motor 27 speed of rotation which is approximately equal to the speed of rotation of take-up spool 12. Thus, when feed spool motor 27 is energized at step 5, feed spool 26 immediately begins to rotate at substantially the same speed of rotation as take-up spool 12.

The subsequent operation of apparatus 10 continues to cycle through steps 1-5 as described above. After the first operational cycle of apparatus 10 incident to apparatus 10 start-up, however, the magnitude of the distance the pivot arm 34 travels during subsequent operational cycles of apparatus 10 is relatively small and insignificant. Any tension on the wire 22 now only comes from the weight of the pivot arm 34 itself. A predetermined, substantially constant tension of wire 22 is thereby established and maintained by apparatus 10. It is to be further understood that the operation of apparatus 10*a* in FIG. 2 is in all essential respects identical to the operation of apparatus 10, with the exception that the speed of motor 25 is controlled, instead of motor 27, as disclosed for the operation of apparatus 10. It is to be further understood that the predetermined tension on apparatus 10 is established by the downward force (e.g. weight) of pivot arm 34, whereas the predetermined tension on apparatus 10*a* is established by the angle away from vertical that the pendulum arm 48 hangs, the angle being established by the position of the first optical sensor 62*a* vis-a-vis receiver 64*a*.

Additionally, it will be appreciated that in the event that wire 22 becomes slack, e.g., from take-up spool 12 stoppage or wire 22 breakage, pendulum pivot arm 48 hangs freely and interrupts the light path between source 62*b* and receiver 64*b*. Receiver 64*b* sends a signal to relays 108, 110 to cause relays 108, 110 to respectively interrupt power to stepper motor 74 and motor 25.

While the particular low tension transfer system as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

We claim:

1. A system for transferring wire with a predetermined tension, which comprises:

a base;

a first rotatable spool;

a first electric motor for rotating said first spool;

means electrically connected to said first electric motor for selectively establishing a predetermined rotational speed of said first spool;

a second rotatable spool, said wire being attached to said first and second spools for feeding said wire from said second spool to said first spool when said first spool is rotated;

a second electric motor for rotating said second spool;

an arm having a pivot point and a free end, said arm movably mounted about said pivot point on said base adjacent said wire, wherein said free end urges against said wire with a force and positions said arm in a preselected orientation;

a potentiometer electronically connected to said arm for generating a first signal representative of the direction of motion of said arm;

a position sensor having a light source positioned adjacent said arm and having a light receiver distanced from said light source to establish a gap therebetween for generating a second signal when said arm deviates from said preselected orientation and is positioned in said gap; and control means electrically connected to said potentiometer, said position sensor and said second electric motor for establishing a speed of rotation of said second spool in response to said first and second signals to maintain said pivot arm in said preselected orientation.

2. A system as recited in claim 1 wherein said arm maintains said preselected orientation in response to said predetermined tension.

3. A system as recited in claim 1 further comprising a weight attached to said arm to modify said force whereby said free end urges against said wire.

4. A system as recited in claim 1 wherein said control means includes:

a stepper motor electrically connected to said second motor for establishing said speed of said second motor; and a microprocessor electrically connected to said potentiometer, said light receiver, and said stepper motor for controlling said stepper motor in response to said first and second signals.

5. An apparatus for controlling the transfer of a wire with low tension, which comprises:

means for pulling said wire at a predetermined speed, said pulling means including a first rotatable spool and a first electric motor connected thereto;

means for feeding said wire to said pulling means, said feeding means having a speed and said feeding means including a second rotatable spool and a second electric motor connected thereto;

an elongated pivot arm, said arm having a free end and a pivot point, said pivot arm being positioned adjacent said wire with said free end in contact with said wire and urging against said wire such that said pivot arm has a preselected orientation, said pivot arm further being pivotable about said pivot point in response to motion of said wire;

a potentiometer connected to said pivot arm for generating a first signal representative of the direction of motion of said pivot arm;

a light source positioned adjacent said pivot arm;

a light receiver distanced from said light source to established a gap therebetween, said receiver generating a second signal when said pivot arm is positioned in said gap; and control means electrically connected to said potentiometer, said light receiver and said feeding means, said control means being responsive to said first and second signals for controlling said speed of said feeding means to maintain said pivot arm in said preselected orientation.

6. An apparatus as recited in claim 5 wherein said control means includes:

a stepper motor electrically connected to said second motor for establishing said speed of said second motor; and a microprocessor electrically connected to said potentiometer, said light receiver, and said stepper motor for controlling said stepper motor in response to said first and second signals.

7. A method for maintaining a predetermined tension of a wire during a wire transfer process, comprising the steps of:

attaching said wire to a rotatable take-up spool having a selectable speed of rotation;

attaching said wire to a rotatable speed control spool having an adjustable speed of rotation;

positioning a pivotable arm against said wire to establish a preselected orientation for said arm;

rotating said take-up spool to feed wire from said speed control spool to said take-up spool;

sensing the direction of pivotal motion of said arm from said preselected orientation by connecting said arm to a potentiometer and generating a first signal representative thereof;

sensing the position of the pivot arm by positioning an optical sensor in juxtaposition to said arm and generating a second signal representative thereof; and adjusting said speed of rotation of said speed control spool in response to said first and second signals to maintain said arm in said preselected orientation.

* * * * *